United States Patent [19]

Huang et al.

[11] Patent Number: 4,842,820

[45] Date of Patent: Jun. 27, 1989

[54] BORON-MODIFIED TITANIUM ALUMINUM ALLOYS AND METHOD OF PREPARATION

[75] Inventors: Shyh-Chin Huang, Latham; Michael F. X. Gigliotti, Jr., Scotia, both of N.Y.

[73] Assignee: General Electric Company, Schenectady, N.Y.

[21] Appl. No.: 138,486

[22] Filed: Dec. 28, 1987

[51] Int. Cl.[4] ..... C25C 3/06; C22C 14/00

[52] U.S. Cl. ..... 420/418; 420/419; 420/421

[58] Field of Search ..... 420/418, 419, 421

[56] References Cited

U.S. PATENT DOCUMENTS

| | | | |
|---|---|---|---|
| 3,203,794 | 8/1965 | Jaffee et al. | 420/418 |
| 4,514,268 | 4/1985 | DeAngelis | 204/279 |
| 4,661,316 | 4/1980 | Hashimoto et al. | 420/418 |

FOREIGN PATENT DOCUMENTS

| | | | |
|---|---|---|---|
| 0220571 | 7/1957 | Australia | 420/418 |

OTHER PUBLICATIONS

"Research, Development, and Prospects of TiAl Intermetallic Compound Alloys" by Tokuzo Tsujimoto, Titanium and Zirconium, vol. 33, No. 3, 159 Jul., 1985, pp. 1–19.

"Titanium Aluminides—An Overview" by Harry A. Lipsitt, Mat. Res. Soc. Symposium, Proc. Vol. 39, 1985 Materials Research Society, pp. 351–364.

"Effect of Rapid Solidification in $Ll_o$ TiAl Compound Alloys" by S. H. Whang et al., ASM Symposium Proceedings on Enhanced Properties in Struc, Metals Via Rapid Solidification, Materials Week, 1986, Oct. 1986, pp. 1–7.

Izvestiya Akademii Nauk SSR, Metally, No. 3, pp. 164–168, 1984.

"The Effects of Alloying on the Microstructure and Properties of $Ti_3Al$ and TiAl", P. L. Martin, H. A. Lipsitt, N. T. Nuhfer & J. C. Williams, Titanium 80, (Published by the American Society of Metals, Warrendale, PA), vol. 2, pp. 1245–1254, 1980.

*Primary Examiner*—Upendra Roy

*Attorney, Agent, or Firm*—Paul E. Rochford; James C. Davis, Jr.; James Magee, Jr.

[57] ABSTRACT

A TiAl composition is prepared to have high strength and to have improved ductility by altering the atomic ratio of the titanium and aluminum to have what has been found to be a higly desirable effective aluminum concentration by addition of boron according to the approximate compositions displayed in the shaded area of FIG. 10.

9 Claims, 9 Drawing Sheets

BORON-MODIFIED TITANIUM ALUMINUM ALLOYS AND METHOD OF PREPARATION

CROSS REFERENCE TO RELATED APPLICATIONS

The subject application relates to copending applications as follows:

Ser. No. 138,476 (RD-17,609) filed 12-28-87;
Ser. No. 138,485 (RD-17,791) filed 12-28-87;
Ser. No. 138,481 (RD-17,792) filed 12-28-87;
Ser. No. 138,407 (RD-17,813) filed 12-28-87; and
Ser. No. 138,408 (RD-18,454) filed 12-28-87.

The texts of these related applications are incorporated herein by reference.

BACKGROUND OF THE INVENTION

The present invention relates generally to alloys of titanium and aluminum. More particularly it relates to alloys of titanium and aluminum which have been modified both with respect to stoichiometric ratio and with respect to boron addition.

It is known that as aluminum is added to titanium metal in greater and greater proportions the crystal form of the resultant titanium aluminum composition changes. Small percentages of aluminum go into solid solution in titanium and the crystal form remains that of alpha titanium. At higher concentrations of aluminum (including about 25 to 35 atomic %) an intermetallic compound $Ti_2Al$ is formed. The $Ti_3Al$ has an ordered hexagonal crystal form called alpha-2. At still higher concentrations of aluminum (including the range of 50 to 60 atomic % aluminum) another intermetallic compound, TiAl, is formed having an ordered tetragonal crystal form called gamma.

The alloy of titanium and aluminum having a gamma crystal form and a stoichiometric ratio of approximately one is an intermetallic compound having a high modulus, a low density, a high thermal conductivity, good oxidation resistance, and good creep resistance. The relationship between the modulus and temperature for TiAl compounds to other alloys of titanium and in relation to nickel base superalloys is shown in FIG. 1. As is evident from the figure the TiAl has the best modulus of any of the titanium alloys. Not only is the TiAl modulus higher at higher temperature but the rate of decrease of the modulus with temperature increase is lower for TiAl than for the other titanium alloys. Moreover, the TiAl retains a useful modulus at temperatures above those at which the other titanium alloys become useless. Alloys which are based on the TiAl intermetallic compound are attractive lightweight materials for use where high modulus is required at high temperatures and where good environmental protection is also required.

One of the characteristics of TiAl which limits its actual application to such uses is a brittleness which is found to occur at room temperature. Also the strength of the intermetallic compound at room temperature needs improvement before the TiAl intermetallic compound can be exploited in structural component applications. Improvements of the TiAl intermetallic compound to enhance ductility and/or strength at room temperature are very highly desirable in order to permit use of the compositions at the higher temperatures for which they are suitable.

With potential benefits of use at light weight and at high temperatures, what is most desired in the TiAl compositions which are to be used is a combination of strength and ductility at room temperature. A minimum ductility of the order of one percent is acceptable for some applications of the metal composition but higher ductilities are much more desirable. A minimum strength for a composition to be useful is about 50 ksi or about 350 MPa. However, materials having this level of strength are of marginal utility and higher strengths are often preferred for some applications.

The stoichiometric ratio of TiAl compounds can vary over a range without altering the crystal structure. The aluminum content can vary from about 50 to about 60 atom percent. The properties of TiAl compositions are subject to very significant changes as a result of relatively small changes of one percent or more in the stoichiometric ratio of the titanium and aluminum ingredients. Also the properties are similarly affected by the addition of similar relatively small amounts of ternary elements.

PRIOR ART

There is extensive literature on the compositions of titanium aluminum including the $Ti_3Al$ intermetallic compound, the TiAl intermetallic compounds and the $TiAl_3$ intermetallic compound. A patent, U.S. Pat. No. 4,294,615, entitled "Titanium Alloys of the TiAl Type" contains an extensive discussion of the titanium aluminide type alloys including the TiAl intermetallic compound. As is pointed out in the patent in column 1 starting at line 50 in discussing TiAl's advantages and disadvantages relative to $Ti_3Al$:

"It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys."

It is known that the alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

"Those well skilled recognize that there is a substantial difference between the two ordered phases. Alloying and transformational behavior of $Ti_3Al$ resemble those of titanium as the hexagonal crystal structures are very similar. However, the compound TiAl has a tetragonal arrangement of atoms and thus rather different alloying characteristics. Such a distinction is often not recognized in the earlier literature."

The '615 patent does describe the alloying of TiAl with vanadium and carbon to achieve some property improvements in the resulting alloy.

A number of technical publications dealing with the titanium aluminum compounds as well as with the characteristics of these compounds are as follows:

1. E. S. Bumps, H. D. Kessler, and M. Hansen, "Titanium-Aluminum System", *Journal of Metals*, June, 1952, pp. 609–615, TRANSACTIONS AIME, Vol. 194.

2. H. R. Ogden, D. J. Maykuth, W. L. Finaly, and R. I. Jaffee, "Mechanical Properties of High Purity Ti-Al Alloys", *Journal of Metals*, February, 1953, pp. 267–272, TRANSACTIONS AIME, Vol. 197.

3. Joseph B. McAndrew, and H.D. Kessler, "Ti-36 Pct Al as a Base for High Temperature Alloys", *Journal of Metals*, October, 1956, pp. 1348–1353, TRANSACTIONS AIME, Vol. 206.

4. Barinov, S. M.; Nartova, T. T.; Krasulin, Yu L.; and Mogutova, T.V., "Temperature Dependence of the Strength and Fracture Toughness of Titanium Aluminum", Izv. Akad. Nauk SSSR, Met., Vol. 5, 1983, p. 170.

In reference 4, Table I, a composition of titanium-36 aluminum -0.01 boron is reported and this composition is reported to have an improved ductility. This composition corresponds in atomic percent to $Ti_{50}Al_{49.97}B_{0.03}$.

BRIEF DESCRIPTION OF THE INVENTION

One object of the present invention is to provide a method of forming a titanium aluminum intermetallic compound having improved ductility and related properties at room temperature.

Another object is to improve the properties of titanium aluminum intermetallic compounds at low and intermediate temperatures.

Another object is to provide an alloy of titanium and aluminum having improved properties and processability at low and intermediate temperatures.

Other objects will be in part, apparent and in part, pointed out in the description which follows.

In one of its broader aspects the objects of the present invention are achieved by providing a nonstoichiometric TiAl base alloy, and adding a relatively low concentration of boron to the nonstoichiometric composition. The addition may be followed by rapidly solidifying the boron-containing nonstoichiometric TiAl intermetallic compound. Addition of boron in the order of approximately 0.25 to 1.5 parts in 100 is contemplated.

The rapidly solidified composition may be consolidated as by isostatic pressing and extrusion to form a solid composition of the present invention.

DETAILED DESCRIPTION OF THE INVENTION

EXAMPLES 1–3

Figure 1:
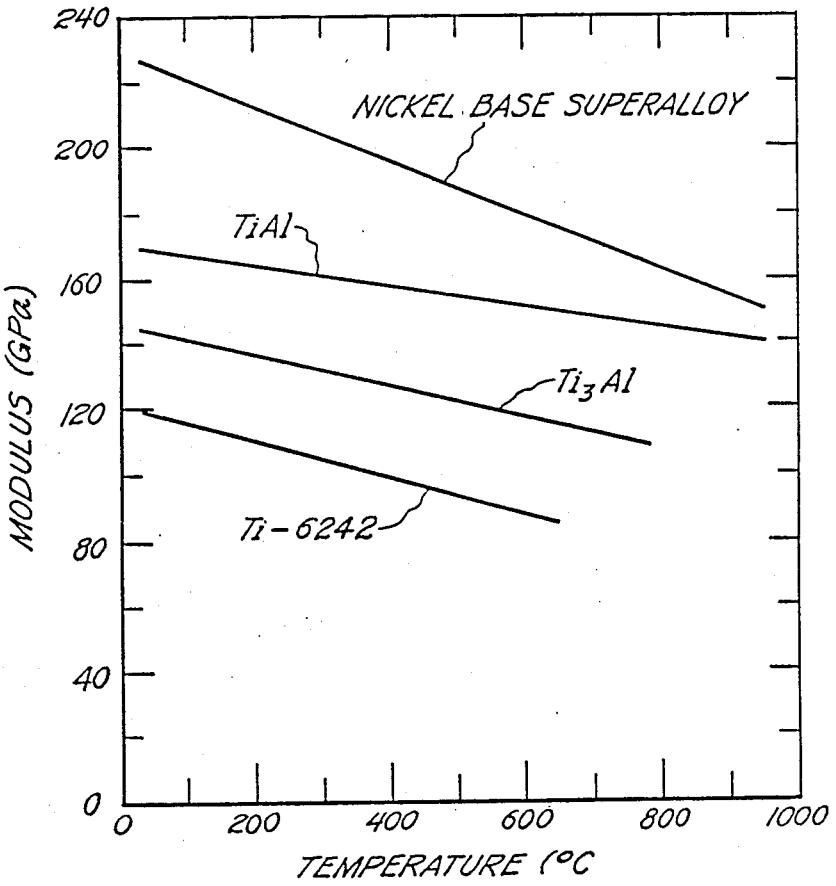
FIG. 1 is a graph illustrating the relationship between modulus and temperature for an assortment of alloys.

Three individual melts were prepared to contain titanium and aluminum in various stoichiometric ratios approximating that of TiAl. The compositions, annealing temperatures and test results of tests made on the compositions are set forth in Table I.

For each example the alloy was first made into an ingot by electro arc melting. The ingot was processed into ribbon by melt spinning in a partial pressure of argon. In both stages of the melting, a water-cooled copper hearth was used as the container for the melt in order to avoid undesirable melt-container reactions. Also care was used to avoid exposure of the hot metal to oxygen because of the strong affinity of titanium for oxygen.

The rapidly solidified ribbon was packed into a steel can wich was evacuated and then sealed. The can was then hot isostatically pressed (HIPped) at 950° C. (1740° F.) for 3 hours under a pressure of 30 ksi. The HIPping can was machined off the consolidated ribbon plug. The HIPped sample was a plug about one inch in diameter and three inches long.

The plug was placed axially into a center opening of a billet and sealed therein. The billet was heated to 975° C. (1787° F.) and was extruded through a die to give a reduction ratio of about 7 to 1. The extruded plug was removed from the billet and was heated treated.

The extruded samples were then annealed at temperatures as indicated in Table I for two hours. The annealing was followed by aging at 1000° C. for two hours. Specimens were machined to the dimension of $1.5\times3\times25.4$ mm ($0.060\times0.120\times1.0$ in) for four point bending tests at room temperature. The bending tests were carried out in a 4-point bending fixture having an inner span of 10 mm (0.4 in) and an outer span of 20 mm (0.8 in). The load-crosshead displacement curves were recorded. Based on the curves developed the following properties are defined:

1. Yield strength is the flow stress at a cross head displacement of one thousandth of an inch. This amount of cross head displacement is taken as the first evidence of plastic deformation and the transition from elastic deformation to plastic deformation. The measurement of yield and/or fracture strength by conventional compression or tension methods tends to give results which are lower than the results obtained by four point bending as carried out in making the measurements reported herein. The higher levels of the results from four point bending measurements should be kept in mind when comparing these values to values obtained by the conventional compression or tension methods. However, the comparison of measurement results in the examples herein is between four point bending tests for all samples measured and such comparisons are quite valid in establishing the differences in strength properties resulting from differences in composition or in processing of the compositions.

2. Fracture strength is the stress to fracture,

3. Outer fiber strain is the quantity of 9.71hd, where h is the specimen thickness in inches and d is the cross head displacement of fracture in inches. Metallurgically, the value calculated represents the amount of plastic deformation experienced at the outer surface of the bending specimen at the time of fracture.

Figure 2:
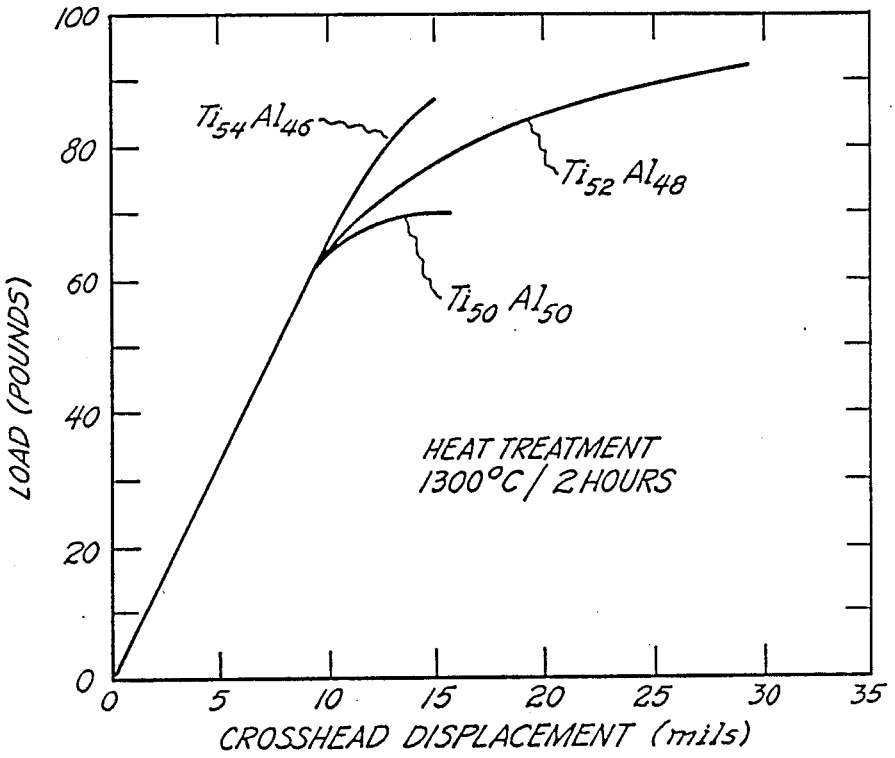
FIG. 2 is a graph illustrating the relationship between load in pounds and crosshead displacement in mils for TiAl compositions of different stoichiometry tested in 4-point bending.
Figure 3:
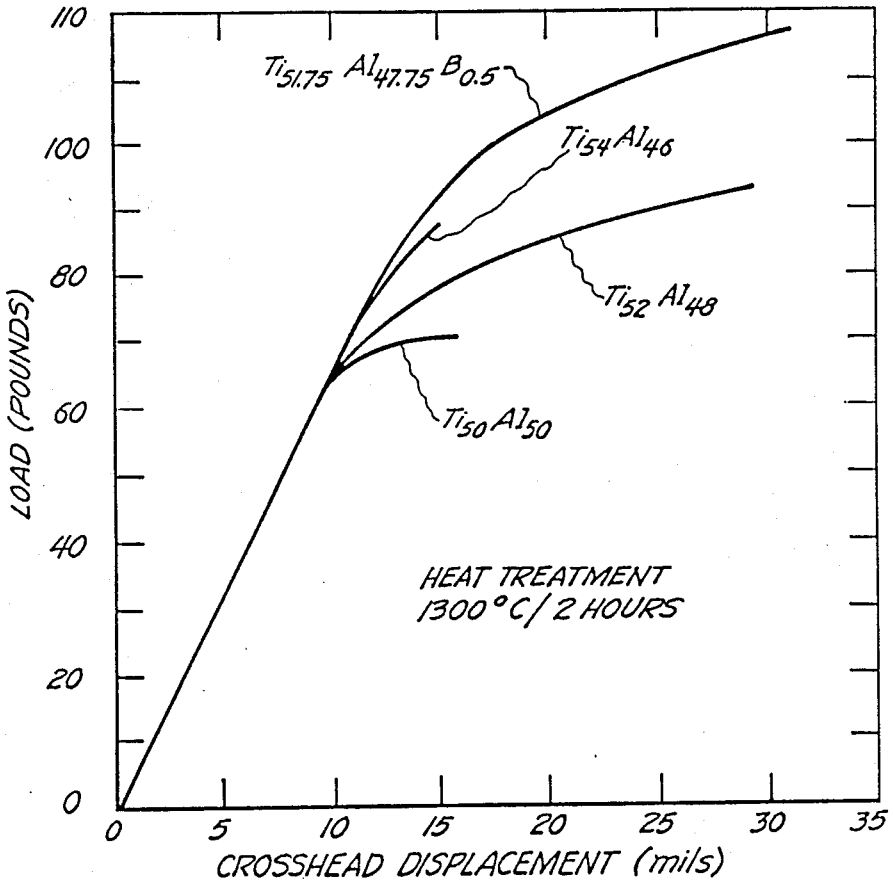
FIG. 3 is a graph similar to that of FIG. 2 but indicating the values established for a composition 70 discussed below with reference to Example 14.

The results are listed in the following Table I. Table I contains data on the properties of samples annealed at 1300° C. and further data on these samples in particular is given in FIG. 2.

TABLE I

| Ex. No. | Gamma Alloy No. | Com-posit. (wt. %) | Anneal Temp (°C.) | Yield Strength (ksi) | Fracture Strength (ksi) | Outer Fiber Strain (%) |
|---|---|---|---|---|---|---|
| 1 | 83 | $Ti_{54}Al_{46}$ | 1250 | 131 | 132 | 0.1 |
| | | | 1300 | 111 | 120 | 0.1 |
| | | | 1350 | * | 58 | 0 |
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| | | | 1400 | 70 | 85 | 0.2 |
| 3 | 85 | $Ti_{50}Al_{50}$ | 1250 | 83 | 92 | 0.3 |
| | | | 1300 | 93 | 97 | 0.3 |
| | | | 1350 | 78 | 88 | 0.4 |

*No measurable value was found because the sample lacked sufficient ductility to obtain a measurement.

It is evident from the data of this table that alloy 12 for Example 2 exhibited the best combination of properties. This confirms that the properties of Ti-Al compositions are very sensitive to the Ti/Al atomic ratios and to the heat treatment applied. Alloy 12 was selected as the base alloy for further property improvements based on further experiments which were performed as described below.

It is also evident that the anneal at temperatures between 1250° C. and 1350° C. results in the test specimens having desirable levels of yield strength, fracture strength and outer fiber strain. However, the anneal at 1400° C. results in a test specimen having a significantly lower yield strength (about 20% lower); lower fracture strength (about 30% lower) and lower ductility (about 78% lower) than a test specimen annealed at 1350° C. The sharp decline in properties is due to a dramatic change in microstructure due in turn to an extensive beta transformation at temperatures appreciably above 1350° C.

EXAMPLES 4–13

Ten additional individual melts were prepared to contain titanium and aluminum in designated atomic ratios as well as additives in relatively small atomic percents.

Each of the samples was prepared as described above with reference of Examples 1–3.

The compositions, annealing temperatures, and test results of tests made on the compositions are set forth in Table II in comparison to alloy 12 as the base alloy for this comparison.

TABLE II

| Ex. No. | Gamma Alloy No. | Composit. (at. %) | Anneal Temp. (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 4 | 22 | $Ti_{50}Al_{47}Ni_3$ | 1200 | —* | 131 | 0 |
| 5 | 24 | $Ti_{52}Al_{46}Ag_2$ | 1200 | —* | 114 | 0 |
| | | | 1300 | 92 | 117 | 0.5 |
| 6 | 25 | $Ti_{50}Al_{48}Cu_2$ | 1250 | —* | 83 | 0 |
| | | | 1300 | 80 | 107 | 0.8 |
| | | | 1350 | 70 | 102 | 0.9 |
| 7 | 32 | $Ti_{54}Al_{45}Hf_1$ | 1250 | 130 | 136 | 0.1 |
| | | | 1300 | 72 | 77 | 0.1 |
| 8 | 41 | $Ti_{52}Al_{44}Pt_4$ | 1250 | 132 | 150 | 0.3 |
| 9 | 45 | $Ti_{51}Al_{47}C_2$ | 1300 | 136 | 149 | 0.1 |
| 10 | 57 | $Ti_{50}Al_{48}Fe_2$ | 1250 | —* | 89 | 0 |
| | | | 1300 | —* | 81 | 0 |
| | | | 1350 | 86 | 111 | 0.5 |
| 11 | 82 | $Ti_{50}Al_{48}Mo_2$ | 1250 | 128 | 140 | 0.2 |
| | | | 1300 | 110 | 136 | 0.5 |
| | | | 1350 | 80 | 95 | 0.1 |
| 12 | 39 | $Ti_{50}Al_{46}Mo_4$ | 1200 | —* | 143 | 0 |
| | | | 1250 | 135 | 154 | 0.3 |
| | | | 1300 | 131 | 149 | 0.2 |
| 13 | 20 | $Ti_{49.5}Al_{49.5}Er_1$ | + | + | + | + |

*See asterisk note to Table I.
+ Material fractured during machining to prepare test specimens.

For Examples 4 and 5 heat treated at 1200° C., the yield strength was unmeasurable as the ductility was found to be essentially nil. For the specimen of Example 5 which was annealed at 1300° C., the ductility increased, but it was still undesirably low.

For Example 6 the same was true for the test specimen annealed at 1250° C. For the specimens of Example 6 which were annealed at 1300° and 1350° C. the ductility was significant but the yield strength was low.

None of the test specimens of the other Examples were found to have any significant level of ductility.

It is evident from the results listed in Table II that the sets of parameters involved in preparing compositions for testing are quite complex and interrelated. One parameter is the atomic ratio of the titanium relative to that of aluminum. From the data plotted in FIG. 2 it is evident that the stoichiometric ratio or non-stoichiometric ratio has a strong influence on the test properties which are formed for different compositions.

Another set of parameters is the additive chosen to be included into the basic TiAl composition. A first parameter of this set concerns whether a particular additive acts as a substituent for titanium or for aluminum. A specific metal may act in either fashion and there is no simple rule by which it can be determined which role an additive will play. The significance of this parameter is evident if we consider addition of some atomic percentage of additive X.

If X acts as a titanium substituent then a composition $Ti_{48}Al_{48}X_4$ will give an effective aluminum concentration of 48 atomic percent and an effective titanium concentration of 52 atomic percent.

If by contrast the X additive acts as an aluminum substituent then the resultant composition will have an effective aluminum concentration of 52 percent and an effective titanium concentration of 48 atomic percent.

Accordingly the nature of the substitution which takes place is very important but is also highly unpredictable.

Another parameter of this set is the concentration of the additive.

Still another parameter evident from Table II is the annealing temperature. The annealing temperature which produces the best strength properties for one additive can be seen to be different for a different additive. This can be seen by comparing the results set forth in Example 6 with those set forth in Example 7.

In addition there may be a combined concentration and annealing effect for the additive so that optimum property enhancement, if any enhancement is found, can occur at a certain combination of additive concentration and annealing temperature so that higher and lower concentrations and/or annealing temperatures are less effective in providing a desired property improvement.

The content of Table II makes clear that the results obtainable from addition of a ternary element to a nonstoichiometric TiAl composition are highly unpredictable and that most test results are unsuccessful with respect to ductility of strength or to both.

EXAMPLES 14 through 16

Three additional samples were prepared as described above with reference to Examples 1–3 to contain boron modified titanium aluminide having compositions as listed in Table III.

Table III summarizes the bend test results on all of the alloys both standard and modified under the various heat treatment conditions deemed relevant.

TABLE III

FOUR-POINT BEND PROPERTIES OF B-MODIFIED TiAl ALLOYS

| Ex. | Gamma Alloy No. | Composition (at. %) | Annealing Temperature (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 14 | 70 | $Ti_{51.75}Al_{47.75}B_{0.5}$ | 1250 | 126 | 151 | 0.5 |
| | | | 1300 | 122 | 158 | 0.8 |
| | | | 1350 | 111 | 139 | 0.6 |
| 15 | 26 | $Ti_{51.5}Al_{47.5}B_1$ | 1250 | 128 | 153 | 0.3 |
| | | | 1300 | 122 | 142 | 0.2 |
| | | | 1350 | 101 | 125 | 0.3 |
| 16 | 46 | $Ti_{51}Al_{47}B_2$ | 1300 | 117 | 129 | 0.2 |
| | | | 1350 | 113 | 139 | 0.4 |

In Table III the compositions shown a distribution of boron as equally appropriated by titanium and aluminum. Boron has been found to be different in its behavior from the other additives discussed above. Rather than serving as a substituent for either titanium or aluminum, the boron is distributed equally between the titanium and aluminum.

The effect of boron concentration was studied at an aluminum level of about 48 at. % by varying the boron content. Alloy 46 prepared with 2 at. % boron and alloy 70 was prepared with 0.5 at. % boron. Alloy 26 had 47.5 at. % aluminum and 1 at. % boron and was part of the series. Alloy 12 had 0 at. % boron. The results are tabulated in Table III.

Referring to Table III it is evident that the boron level does not significantly affect the strength of samples prepared with a 1250° C. anneal. The fine grain structure of these samples appears to be the dominant strength factor.

The strength of the samples annealed at 1350° C. is maintained at about 110 ksi for most of the boron-containing samples of these test series. This strength value is about 20 ksi or about 22% higher than that of the base alloy annealed at the same temperature.

This is a very valuable result and is taken to indicate that boron strengths TiAl by interstitial solid solution hardening. It is also taken to indicate that boron solubility is near or below 0.5 at. %.

Further it is evident from a study of the results tabulated in Table III that the ductility follows a consistent trend of decreasing with increasing boron concentration. This may possibly be attributed to boride formation at higher boron concentrations. These results are plotted in FIG. 4.

Figure 4:
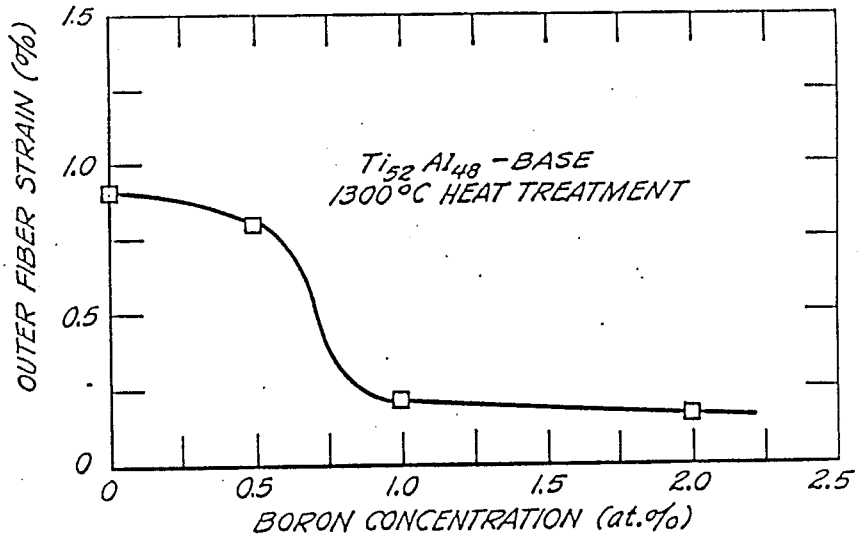
FIG. 4 is a graph showing the relationship between boron concentration and outer fiber strain.
Figure 5:
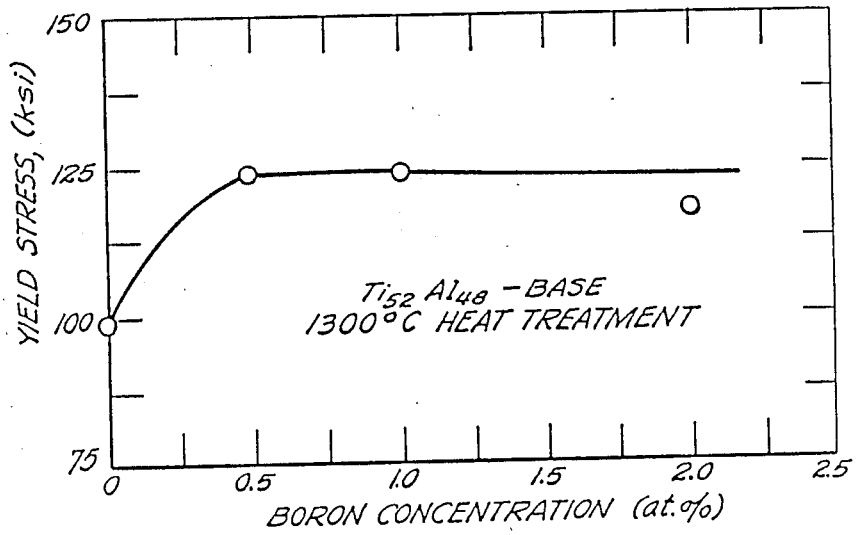
FIG. 5 is a graph showing the relationship between boron concentration and bending yield strength.

The results obtained from the study of the changes in boron concentration are listed in Table III and are plotted in FIGS. 4 and 5. It is evident from the data and particularly from the two plots that optimum properties are achieved at a boron concentration of about 0.5 atomic percent.

EXAMPLES 17–20

Another set of samples were prepared to determine the influence of the variation of aluminum concentration on properties. These samples were prepared as described above with reference to Examples 1–3 and contained the compositions as listed below in Table IV. Table IV also summarizes the bend test results on all of the alloys both standard and modified for the various heat treatment conditions listed. Example 15 had a sample with 47.5 atom percent aluminum and is repeated from Table III as it conforms to the criteria of both Tables III and IV.

TABLE IV

FOUR-POINT BEND PROPERTIES OF TiAl ALLOYS MODIFIED BY 1 AT. % BORON

| Ex. | Gamma Alloy No. | Composition (at. %) | Annealing Temperature (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 17 | 58 | $Ti_{55.5}Al_{43.5}B_1$ | 1250 | 139 | 180 | 0.4 |
| | | | 1300 | 139 | 181 | 0.4 |
| | | | 1350 | 139 | 173 | 0.3 |
| 18 | 100 | $Ti_{54.5}Al_{44.5}B_1$ | 1250 | 158 | 196 | 0.5 |
| | | | 1300 | 119 | 132 | 0.1 |
| | | | 1350 | 141 | 176 | 0.4 |
| 19 | 62 | $Ti_{53.5}Al_{45.5}B_1$ | 1250 | 138 | 191 | 0.9 |
| | | | 1300 | 134 | 174 | 0.6 |
| | | | 1350 | 123 | 168 | 1.0 |
| 20 | 101 | $Ti_{52.5}Al_{46.5}B_1$ | 1250 | 129 | 167 | 0.5 |
| | | | 1300 | 126 | 163 | 0.7 |
| | | | 1350 | 114 | 146 | 0.6 |
| 15 | 26 | $Ti_{51.5}Al_{47.5}B_1$ | 1250 | 128 | 153 | 0.3 |
| | | | 1300 | 122 | 142 | 0.2 |
| | | | 1350 | 101 | 125 | 0.3 |

It will be noted from Table IV that the boron content of the five alloys 58, 62, 26, 100 and 101 is one atomic percent. Again, the boron is distributed equally between the titanium and aluminum.

The samples which were annealed at 1350° C. had lower strengths and this is probably due to grain coarsening.

A comparison among the five alloys indicates that the yield strength decreases with increasing aluminum concentration, particularly after the 1350° C. anneal. Maximum ductility is achieved in alloy 62. These results establish that maximum ductility occurs at an aluminum concentration of 46 atomic percent and at a 1% boron level. The strength of alloy 62 is very substantially greater than that of the base alloy 12.

Figure 6:
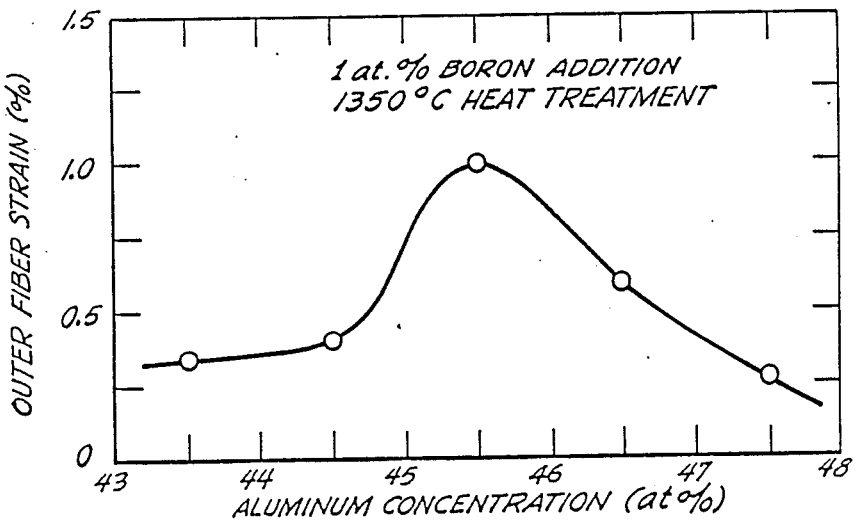
FIG. 6 is a graph showing the relationship between aluminum concentration and outer fiber strain for a TiAl alloy containing boron.
Figure 7:
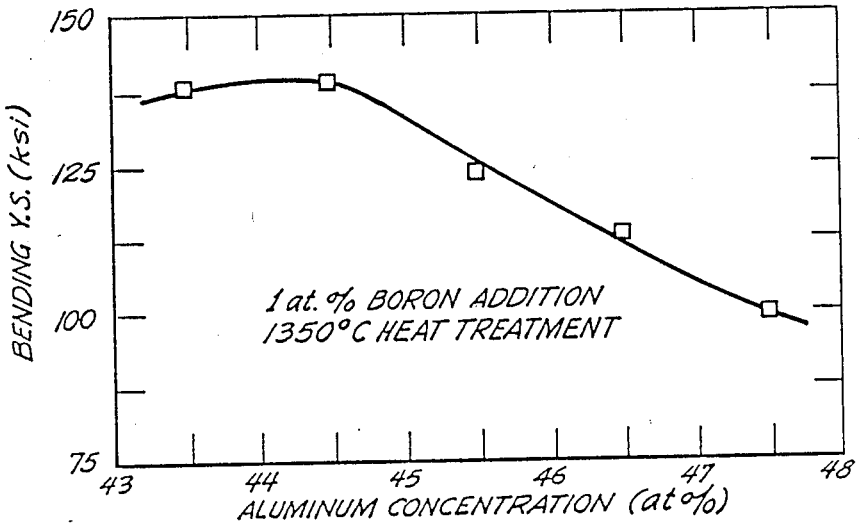
FIG. 7 is a similar graph but showing the relationship between aluminum concentrations and yield strength for a TiAl alloy containing boron.

The relation of outer fiber strain to aluminum concentration is illustrated in FIG. 6. The relation of bending yield stress to aluminum concentration is illustrated in FIG. 7.

We have also discovered that boron has an effect on the phases of the titanium aluminum alloy. When the aluminum is at a concentration of 48 atomic percent in the alloy the alloy normally exists in two phases, beta and gamma.

When 1 at. % boron is added to this alloy the aluminum concentration goes to 47.5 at. % and the alloy becomes essentially single phase alloy. In addition, a small fraction of a boride phase may form.

If, however, the aluminum concentration is reduced by 2 at. % to 45.5 at. % the alloy then again displays its two phase form. The 2 at. % aluminum concentration reduction compensates for a 1 at. % boron addition and the two phase form of the alloy is again present. The experimental results on which these findings are made are included in Table IV above. The results of the experiments of Examples 17 through 20 together with the data of Example 15 are plotted in FIGS. 6 and 7.

Figure 8:
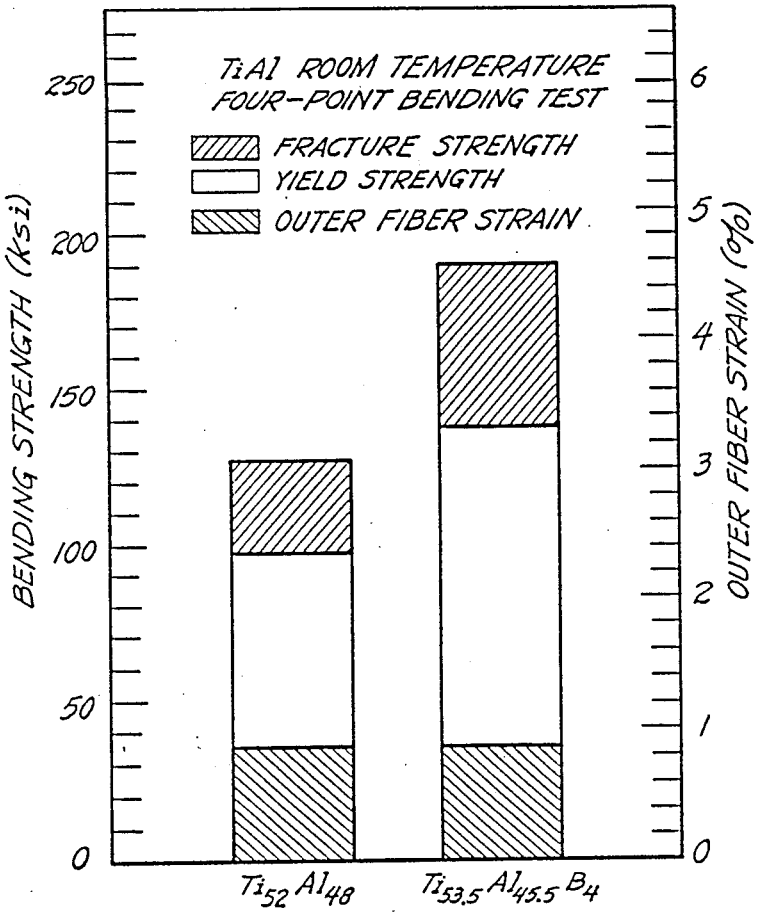
FIG. 8 is a bar graph showing the relation between the fracture strength, yield strength and outer fiber strain for the base metal and the composition of this invention.

A bar graph of FIG. 8 illustrates the relationship of fracture strength, yield strength and outer fiber strain for boron doped TiAl in comparison to the base alloy.

Figure 9:
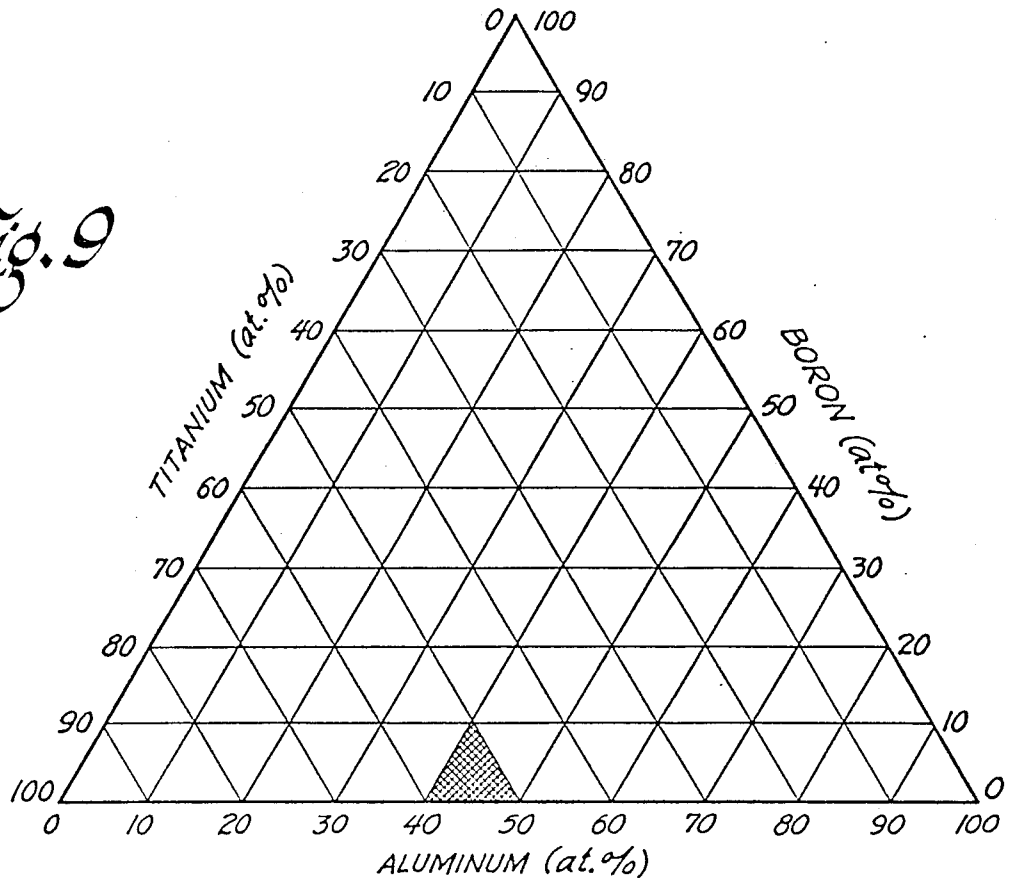
FIG. 9 is a triaxial graph illustrating the location of the plot of FIG. 10.

FIG. 9 is a triaxial plot on which titanium, aluminum and boron compositions may be plotted. The compositions of the present invention fall within the triangle which is cross hatched in the midsection of the lowermost portion of the graph.

Figure 10:
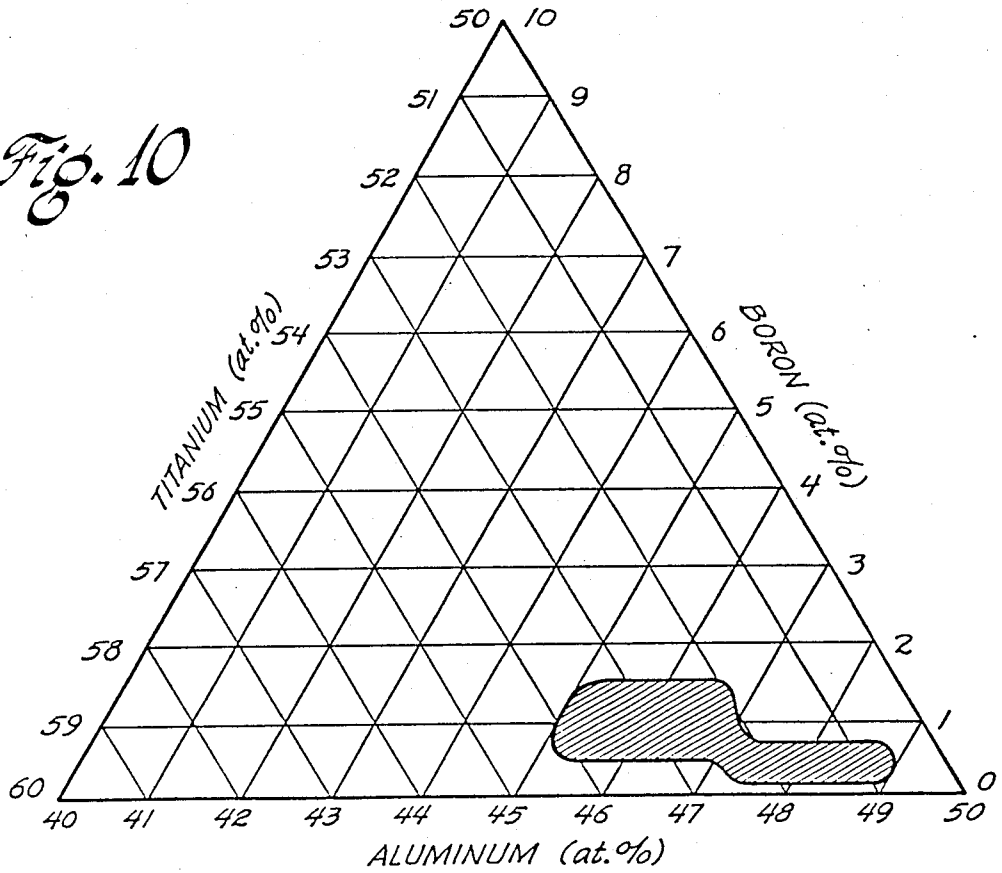
FIG. 10 is a detail of FIG. 9 illustrating the concentrations of titanium, aluminum and boron in compositions of the present invention.

FIG. 10 is a detail of the graph of FIG. 9 which displays only the cross hatched portion of FIG. 9. Within the triangular plot of FIG. 10 a region is outlined in the lower righthand portion of the graph which corresponds to the broader scope of compositions of the present invention.

Figure 11:
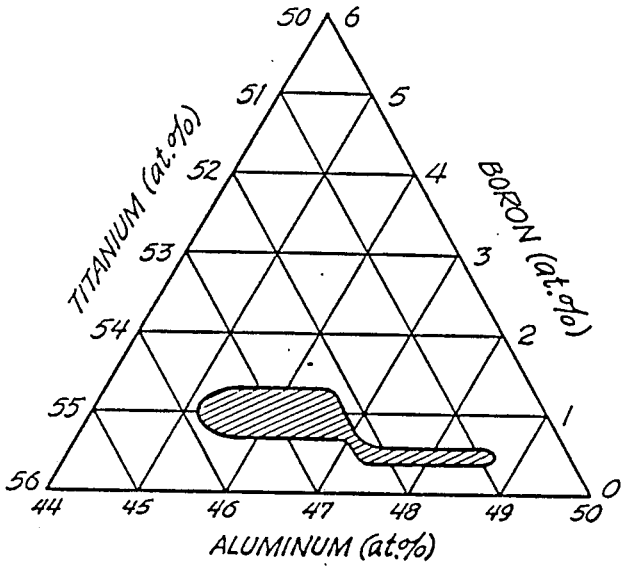
FIG. 11 is a detail of FIG. 9 illustrating a preferred range of the composition as illustrated in FIG. 10.

FIG. 11 is a detail of the graph of FIG. 9 similar to that of FIG. 10 but enclosing a smaller and preferred compositional range of the triaxial plot.

Figure 12:
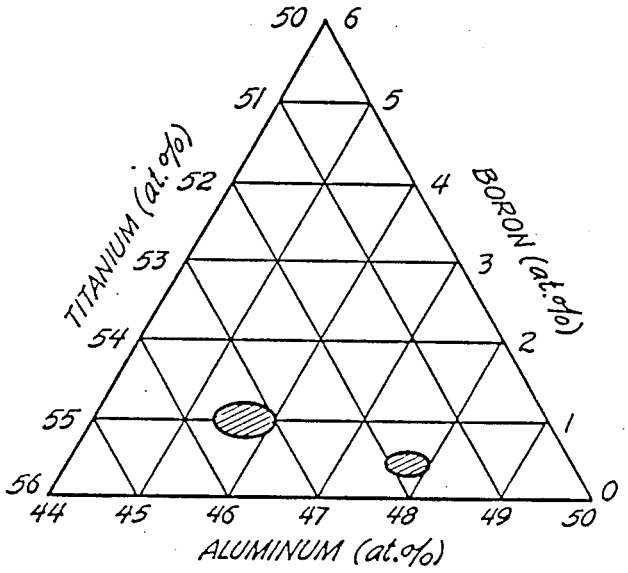
FIG. 12 is a detail of FIG. 9 illustrating the optimum ranges of ingredients of the composition illustrated in FIG. 10.

FIG. 12 is a further detail of the graph of FIG. 9 but enclosing a still smaller and most preferred compositional range of the triaxial plot.

All of the compositions enclosed within the graphs of FIGS. 10, 11 and 12 are based on the data of Tables III and IV and on our interpretation of this data.

What is claimed is:

1. A boron-modified titanium aluminum alloy consisting essentially of titanium, aluminum and boron in the approximate atomic ratios displayed in the hatched area of FIG. 10.

2. A boron modified titanium aluminum alloy consisting essentially of titanium, aluminum and boron in the approximate atomic ratio displayed in the hatched area of FIG. 11.

3. A boron modified titanium aluminum alloy consisting essentially of titanium, aluminum and boron in the approximate atomic ratio displayed in the hatched area of FIG. 12.

4. The alloy of claim 1, said alloy having been rapidly solidified from a melt and consolidated through heat and pressure.

5. The alloy of claim 1, said alloy having been rapidly solidified from a melt and then consolidated through heat and pressure and given a heat treatment at a temperature between 1300° and 1350° C.

6. The alloy of claim 2, said alloy having been rapidly solified from a melt and consolidated through heat and pressure.

7. The alloy of claim 2, said alloy having been rapidly solidified from a melt and then consolidated through heat and pressure and given a heat treatment at a temperature between 1300° and 1350° C.

8. The aloy of claim 3, said alloy having been rapidly solidified from a melt and consolidated through heat and pressure.

9. The alloy of claim 3, said alloy having been rapidly solidified from a melt and then consolidated through heat and pressure and given a heat treatment at a temperature between 1300° and 1350° C.

* * * * *

US004842820B1

REEXAMINATION CERTIFICATE (1701st)

United States Patent [19]

[11] B1 4,842,820

Huang et al.

[45] Certificate Issued May 12, 1992

[54] BORON-MODIFIED TITANIUM ALUMINUM ALLOYS AND METHOD OF PREPARATION

[75] Inventors: Shyh-Chin Huang, Latham; Michael F. X. Gigliotti, Jr., Scotia, both of N.Y.

[73] Assignee: General Electric Company

Reexamination Request:
No. 90/002,205, Nov. 19, 1990

Reexamination Certificate for:

| | |
|---|---|
| Patent No.: | **4,842,820** |
| Issued: | **Jun. 27, 1989** |
| Appl. No.: | **138,486** |
| Filed: | **Dec. 28, 1987** |

[51] Int. Cl.[5] ..... C22C 14/00
[52] U.S. Cl. ..... 420/418; 148/421; 420/419; 420/421
[58] Field of Search ..... 420/418, 419, 421; 148/421

[56] References Cited

U.S. PATENT DOCUMENTS

| | | | |
|---|---|---|---|
| 3,203,794 | 8/1965 | Jaffee et al. | 75/175.5 |
| 4,751,048 | 6/1988 | Christodoulou et al. | 420/129 |
| 4,774,052 | 9/1988 | Nagle et al. | 420/129 |
| 4,836,982 | 6/1989 | Brupbacher et al. | 420/129 |
| 4,849,168 | 7/1989 | Nishiyama et al. | 420/418 |

OTHER PUBLICATIONS

Schuster et al., Z. Metallkde, 81 (1990) 389.
Massalski (editor), Binary Alloy Phase Diagrams Aluminum–Titanium, ASM, 1986, pp. 173–175.
Hyman et al., Met. Trans. 20A (Sep. 1989) 1847.
Hyman et al., Met. Trans. 22A (Jul. 1991) 1647.
D. Shechtman, M. J. Blackburn, and H. A. Lipsitt, "The Plastic Deformation of TiAl", Metallurgical Transactions, vol. 5, pp. 1373–1381 (Jun. 1974).

*Primary Examiner*—Upendra Roy

[57] ABSTRACT

A TiAl composition is prepared to have high strength and to have improved ductility by altering the atomic ratio of the titanium and aluminum to have what has been found to be a highly desirable effective aluminum concentration by addition of boron according to the approximate compositions displayed in the shaded area of FIG. 10.

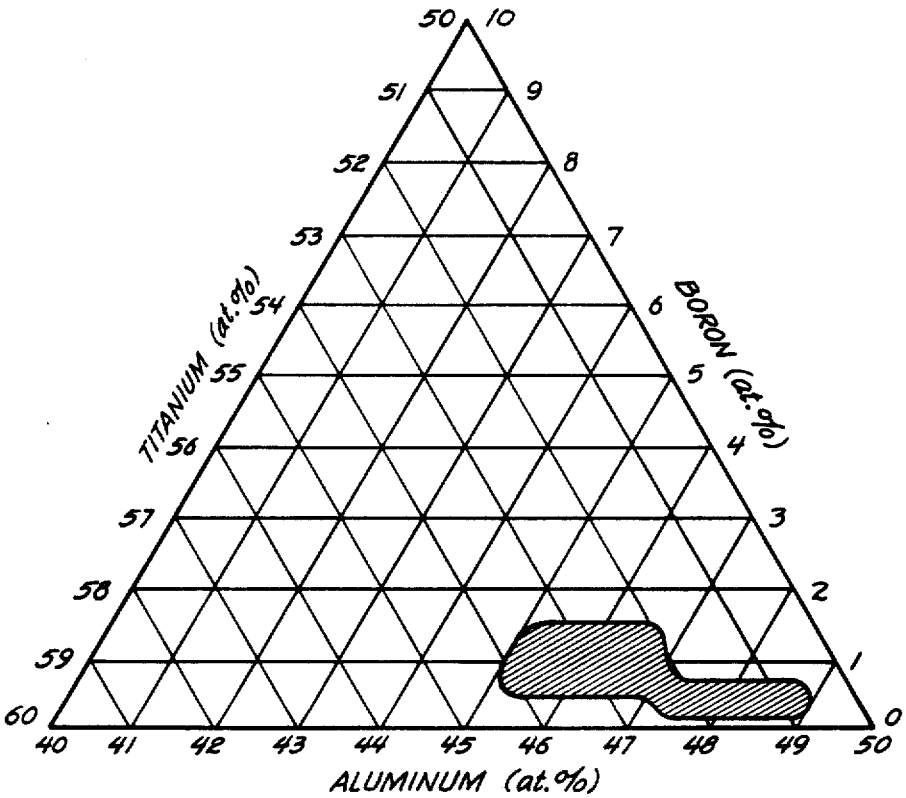

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-3 are determined to be patentable as amended.

Claims 4-9, dependent on an amended claim, are determined to be patentable.

New claims 10-14 are added and determined to be patentable.

1. [A boron-modified titanium aluminum] *A solid solution* alloy *composition cast by rapid solidification means having high strength and ductility of about 1 percent outer fiber strain and a microstructure consisting essentially of titanium aluminide solid solution phases* consisting essentially of titanium, aluminum and boron in the approximate atomic ratios displayed in the hatched area of FIG. 10.

2. [A boron modified titanium aluminum] *A solid solution* alloy *composition cast by rapid solidification means having high strength and ductility of about 1 percent outer fiber strain and a microstructure consisting essentially of titanium aluminide solid solution phases* consisting essentially of titanium, aluminum and boron in the approximate atomic ratio displayed in the hatched area of FIG. 11.

3. [A boron modified titanium aluminum] *A solid solution* alloy *composition cast by rapid solidification means having high strength and ductility of about 1 percent outer fiber strain and a microstructure consisting essentially of titanium aluminide solid solution phases* consisting essentially of titanium, aluminum and boron in the approximate atomic ratio displayed in the hatched area of FIG. 12.

*10. A solid solution alloy composition cast by rapid solidification means, having high strength and ductility of about 1 percent outer fiber strain, and a microstructure consisting essentially of titanium aluminide solid solution phases comprising from about 45 to about 49 atom percent aluminum, about 0.25 to about 1.5 atom percent boron, and the balance consisting essentially of titanium.*

*11. An alloy according to claim 10 having been rapidly solidified from the melt and consolidated through heat and pressure.*

*12. An alloy according to claim 10 comprising about 1 atom percent boron, about 45.5 atom percent aluminum and the balance consisting essentially of titanium.*

*13. An alloy according to claim 10 comprising about 1 atom percent boron, about 46.5 atom percent aluminum, and the balance consisting essentially of titanium.*

*14. An alloy according to claim 10 comprising about 0.5 atom percent boron, about 47.75 atom percent aluminum, and the balance consisting essentially of titanium.*

* * * * *